US006215310B1

(12) United States Patent
Petrovich et al.

(10) Patent No.: US 6,215,310 B1
(45) Date of Patent: Apr. 10, 2001

(54) GLOW PLUG CIRCUIT TESTER

(75) Inventors: Paul A. Petrovich, Livingston County; John J. Schmitz; A. David Stormer, both of Macomb County, all of MI (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/335,818

(22) Filed: Jun. 18, 1999

(51) Int. Cl.[7] ..... F02P 17/00
(52) U.S. Cl. ..... 324/378; 324/537
(58) Field of Search ..... 324/378, 537; 60/289, 274, 285, 293, 660, 671; 123/699, 179.21, 179.6, 145 A, 142.5 E; 219/486, 492, 497, 541; 701/102, 99, 113, 115, 36

(56) References Cited

U.S. PATENT DOCUMENTS 4,862,370 * 8/1989 Arnold et al. ..... 364/431.1

* cited by examiner

*Primary Examiner*—Safet Metjahic
*Assistant Examiner*—E P LeRoux
(74) *Attorney, Agent, or Firm*—Peter A. Taucher; David L. Kuhn

(57) ABSTRACT

A mechanism for testing electrical components in an ignition system of a diesel engine includes a metal jacket having receptacles passing through the jacket and also includes glow plugs fitting in the receptacles. The jacket has an inlet to admit water or other fluid from a pressurized source and also has an outlet to permit the fluid to escape from the jacket. The fluid flows through the jacket and thereby cools the receptacles, jacket and glow plugs. The testing mechanism includes a valve for metering the rate of flow of fluid into the jacket, the rate of flow being kept at a rate sufficient to prevent the jacket's temperature from exceeding a predetermined level. The glow plugs are connected to an electrical power source such as a battery, and a control circuit connected to the electrical power source and the plugs governs the cycle during which the plugs are electrically heated and then permitted to cool. The tips of the glow plugs extend from the jacket and can be seen to glow during the cycle, whereby successful repetitions of the cycle can be viewed and a failure to have a successful cycle can be seen immediately.

5 Claims, 2 Drawing Sheets

GLOW PLUG CIRCUIT TESTER

GOVERNMENT USE

The invention described here may be made, used and licensed by the or for the U.S. Government for governmental purposes without paying me any royalty.

BACKGROUND

The US Army, like many other military organizations, is interested in lengthening the life of its vehicles and vehicle components. Doing so not only reduces the need to purchase new equipment but also reduces the logistical effort needed to sustain vehicles in the field or in forward combat areas. A case in point is the ignition system for the Army's High Mobility Multipurpose Wheeled Vehicle, or HMMWV. Recently, the Army developed a control circuit that increases the life of glow plugs in the HMMWV's diesel engine. Very basically, the circuit operates by imposing a duty cycle on the glow plugs. The cycle controls the level and duration of electrical power sent to the glow plugs to effect engine ignition and provides for controlled delays between applications of electrical power to the plugs. In order to test glow plug life through repetitions of the duty cycle, it was necessary to develop a test mechanism that emulated the environment of the glow plugs, that allowed sensors to be easily mounted on the test apparatus, and that provided a quick, simple way to immediately detect a plug's failure to glow at the appropriate point in the duty cycle. That testing mechanism was developed and is the subject of this patent application.

The mechanism is also useful for testing diesel ignition systems on fielded vehicles generally to determine whether the system is functioning properly. The mechanism is easily built from commonly available materials and requires very little in terms of instrumentation. Also, the source of electrical power and pressurized water needed by the mechanism can be provided by the battery and water pump of an automotive vehicle. Consequently, the mechanism can be used in the field, and particularly can be used under conditions typical of those behind the lines in a combat zone.

SUMMARY

The mechanism comprises an electrical power source and a source of fluid under pressure, the fluid normally being water. The mechanism includes glow plugs receiving power from the electrical power source and a control circuit connected to the electrical power source and the plugs. As mentioned above, the control circuit governs the duty cycle during which the plugs are heated by electricity and allowed cool. The mechanism includes an elongate jacket constructed of thin walls of material conductive of heat and electricity, the jacket having a fluid inlet port at one end and having a fluid outlet port at the other end. The jacket is provided with receptacles which accept the glow plugs, the receptacles being passages that extend all the way through the jacket and seal the plugs from the fluid. The receptacles conduct heat and electricity and provide a link in the electrical path by which the glow plugs are grounded. The tips of the plugs extend out of the receptacle and beyond the jacket and these tips glow when the plugs are energized, whereby the success or failure of the plug to function during energization is immediately apparent to a human viewer. The glowing tips show that there is no break in the electrical path from the power source to the control circuit, or through lines from this circuit to the plugs or in the plugs themselves. Thus, the entire circuit of which the glow plugs are part is visually tested for electrical continuity. The testing mechanism also includes means to control the rate of flow of the fluid through the jacket, and the flow control means can be governed as a function of the jacket's temperature by means of a flow control circuit.

DETAILED DESCRIPTION

Figure 1:
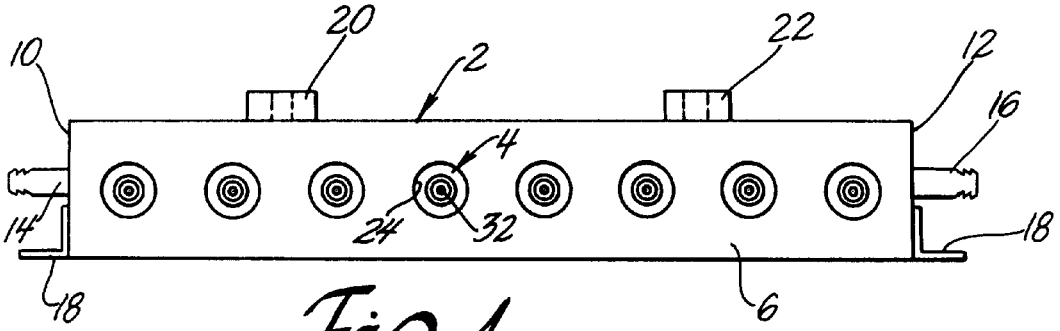
FIG. 1 is a top elevational view of a jacket that is an element of the glow plug circuit tester.
Figure 2:
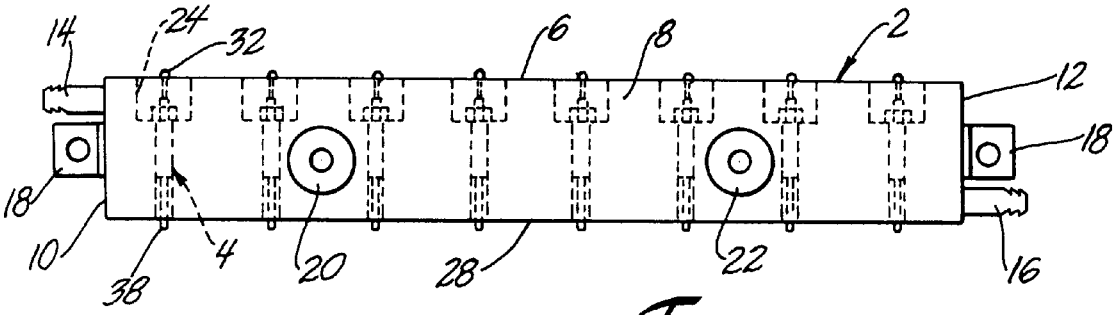
FIG. 2 is a side elevational view of the jacket.
Figure 3:
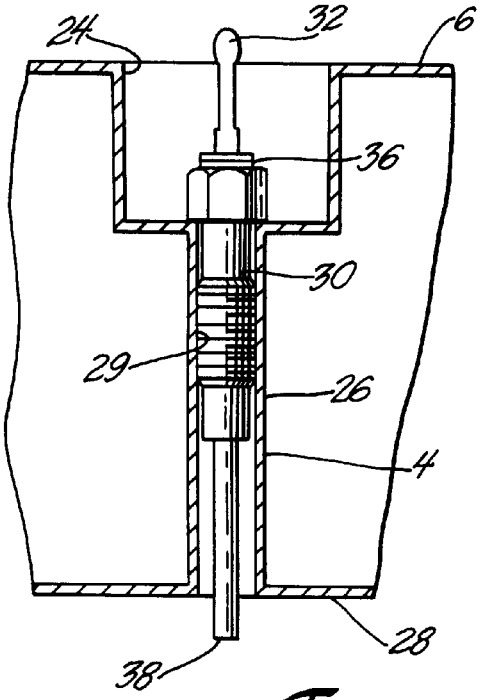
FIG. 3 is a partly sectioned detail view of a receptacle that is a feature of the jacket.

Shown in FIGS. 1 and 2 is a simplified jacket 2 having a plurality of partly threaded receptacles 4 passing therethrough, there being a sectioned detail view of a receptacle shown in FIG. 3. Jacket 2 is hollow and elongate, and preferably has a square or rectangular cross-section. Sides 6 and 8 of jacket 2 are thin metal walls normally fabricated from aluminum sheet or tube stock, but these walls can be fabricated from steel or other metals. Likewise, ends 10 and 12 of the jacket are thin walls made from aluminum or steel, the aforementioned sides and ends forming a sealed rectangular chamber. On end 10 is a fluid inlet nipple 14 and on end 12 is a fluid outlet nipple 16. It is contemplated that hoses will be suitably attached to the nipple so that water, air or other fluid will be introduced and exhausted from the jacket. Also attached to the ends of jacket 2 are brackets 18 by which the jacket can be affixed to a test stand or other suitable structure. A final pair of elements on the exterior of jacket 2 is mount elements 20 and 22, which typically serve as attachment points for temperature sensors or ground wires or like elements.

Receptacle 4 is a sealed circular passage extending all the way through jacket 2. As best seen in FIG. 3, the receptacle may include a well 24 at side 6. From this well leads a narrower, duct-like segment 26 that has an opening at side 28 on the opposite side of jacket 2 from side 6. Intermediate the ends of segment 26 is an internally threaded section 29 that mates with complementary on the body of conventional glow plug 30, which screws into receptacle 4. Glow plug 30 has a connector post 32, a plug body 34, an insulator 36 separating post 32 from body 34, and a glow tip 38 that receives power from post 32. Tip 38 extends beyond side 28 and is exposed to the view of a person observing jacket 2. Plug 30 is grounded in that electricity flows from body 34 to receptacle 4 into jacket 2, which itself is grounded in conventional manner.

Figure 4:
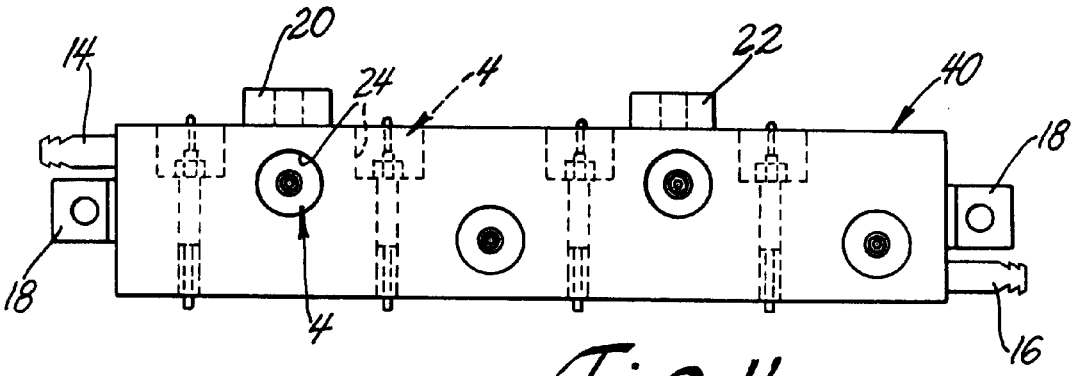
FIG. 4 is the top elevational view of an alternate embodiment of the jacket shown in FIGS. 1 and 2.

FIG. 4 shows a second embodiment 40 of jacket 2. Jacket 40 includes the same receptacles 4 and plugs 30 as jacket 2, except that the receptacles and plugs in jacket 40 have a different juxtaposition relative to the body of the jacket. In FIG. 4, one set of four receptacles and plugs is oriented perpendicularly to a second set of receptacles and plugs. Within each set, the receptacles and plugs are in a staggered relation, not in a straight line. The perpendicularity of the sets and the staggering within sets is believed to increase the receptacles' exposure to fluid flowing through jacket 40 and to thereby increase its cooling efficiency.

Figure 5:
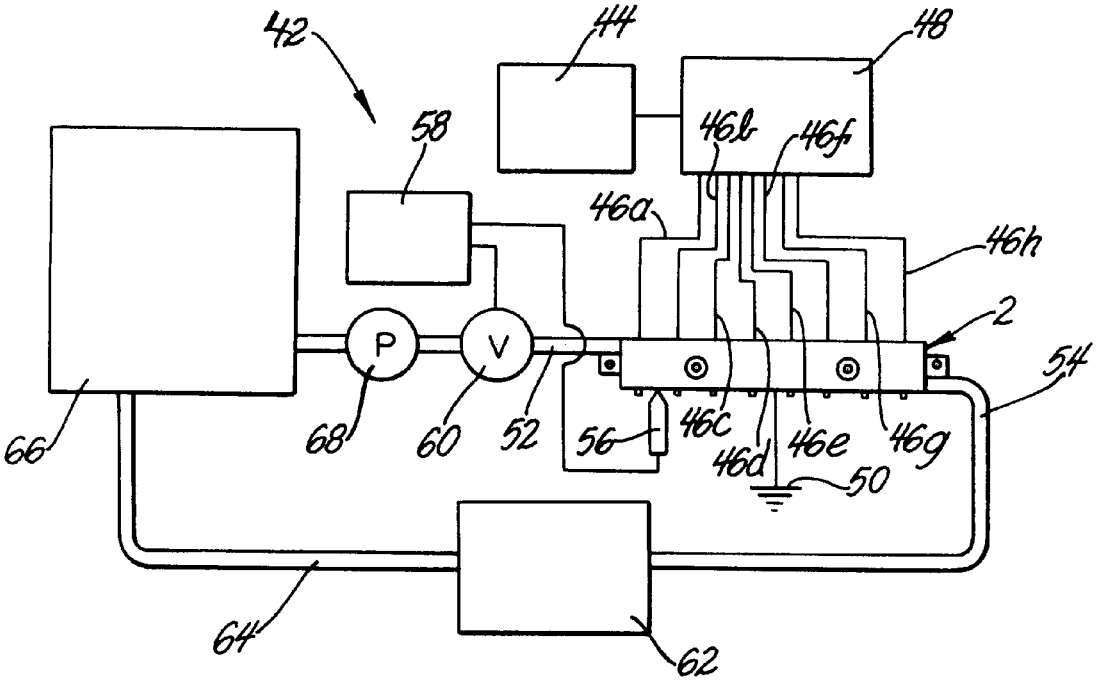
FIG. 5 is a semi-schematic representation of the glow plug circuit testing mechanism of which the jacket is part.

FIG. 5 shows an overall system 42 in which jacket 2 is incorporated. There, electrical power is provided from a source 44, which can be an automotive vehicle battery. Power from source 44 passes to plugs in jacket 2 over lines 46*a* through 46*h*, and the cyclic timing and intensity of power pulses to the plugs is governed by a control circuit 48.

As noted earlier, plugs 30 are grounded through jacket 2, which itself is grounded by a suitable means 50, which can be a vehicle body or a test stand.

Typically for each glow plug, full electrical power is sent to the plug for 6 to 15 seconds, whereupon the plug tip heats to a specified temperature of, say, 1900° F. Thereafter, a partial current is sent to the plug so that it maintains the specified temperature for a predetermined time, which we refer to as the afterglow. Afterglow normally occurs for approximately one minute and then, for another predetermined amount of time, no current is allowed to flow to the plug. The second predetermined time is typically in the neighborhood of two minutes. After the second predetermined amount of time, the cycle can begin again with the 6 to 15 seconds of full power the plug. The particulars of the cycle are described in a prior patent application entitled, "Improved Diesel Engine Starting Controller and Method," Ser. No. 09/030,519 filed Feb. 23, 1998 and having Attorney Docket No. TA-2989.

Tips 38 of plugs 30 glow visibly after being subjected to full electrical power for 6 to 15 seconds and during the afterglow portion of the cycle. This allows the personnel conducting the test to determine whether the plug, the appropriate one of lines 46*a* through 46*h*, control circuit 48 and power source 44 are all operating. Experience has shown that the power source and the plugs are much less likely to fail than the control circuit or the lines on any given occasion when a plug does not glow when it should. Consequently, the test apparatus can be regarded as a mechanism to test the control circuit and the lines. It is contemplated that those ordinarily skilled in the relevant arts could appropriately select from among standard electrical power sources, electrical grounding devices, valves, pumps, reservoirs, cooling mechanisms, valve control circuits, glow plug control circuits and temperature sensors in making an operational replication of applicants' system shown in FIG. 5.

Referring again to FIG. 5, jacket 2 receives fluid through inlet conduit 52, the fluid normally being ordinary tap water or water from the cooling system of a vehicle engine, although air or another gas can be used. Fluid exits jacket 2 via exit conduit 54. The rate of flow of the fluid through jacket 2 is controlled so that that plugs 30 are cooled at the same rate as if they were in an engine, where the engine temperature in the vicinity of the plugs is typically approximately 180° F. We have found that ordinary tap water having a temperature between 50° F. and 60° F. flowing through the jacket at a rate of at least 0.5 gallons/min creates a sufficient cooling effect. A temperature sensor 56 can be used to monitor the jacket's temperature, and the sensor can input to a valve control mechanism 58 governing valve 60. Valve 60 allows more fluid to flow into jacket 2 if the jacket's temperature exceeds a given limit and restricts flow more greatly if the jacket's temperature falls below a given threshold.

Fluid flowing from jacket 2 in line 54 will enter a cooling mechanism 62, which can be a vehicle radiator. From mechanism 62, the fluid is transported via conduit 64 to a reservoir 66. Pump 68, which can be a vehicle water pump, takes fluid from reservoir 66 and provides the pressure in line 52 to initiate fluid flow through jacket 2. An alternative to having cooling mechanism 62 and reservoir 66 is simply to have a source of pressurized water flow into conduit 52 from a faucet and let the water drain from jacket 2 through conduit 54. It will be noted that the system shown in FIG. 5 can be part of a dressed diesel engine assembly, where power source 44 is the vehicle battery, circuit 48 is the vehicle glow plug control circuit, mechanism 62 is the vehicle radiator, and pump 68 is the vehicle's water pump.

We wish it to be understood that we do not desire to be limited to the exact details of construction or method shown herein since obvious modifications will occur to those skilled in the relevant arts without departing from the spirit and scope of the following claims.

What is claimed is:

1. In an arrangement including a source of electrical power, glow plugs and a control circuit operably connected between the glow plugs and the source of electrical power, wherein the control circuit governs cycles of electrical power to the plugs, a testing mechanism exterior to an engine to determine whether the plugs receive power during the cycles, the mechanism comprising:

a hollow jacket;

receptacles in the jacket, the receptacles defining passageways through the jacket;

walls of the receptacles conductive of heat and electricity;

the glow plugs being inserted in the receptacles in thermal and electrical contact with the walls;

tips of the glow plugs extending beyond the jacket out of the receptacles, the tips being in plain view;

means to circulate the coolant through the jacket past the receptacles; and means for grounding the receptacles.

2. The mechanism of claim 1 further comprising:

a valve in the means to circulate coolant;

means for sensing a temperature of the jacket;

a valve-governing circuit connected to the sensor;

wherein the valve is controlled by the governing circuit in response to the temperature sensing means.

3. The mechanism of claim 2 further comprising:

means in fluid communication with the jacket for cooling the fluid;

a pump connected between the cooling means and the jacket; and a fluid reservoir connected to the cooling means and the pump.

4. The mechanism of claim 3 wherein:

the mechanism is installed on a motor vehicle;

the electrical power source is a battery of the vehicle;

the pump is an engine water pump; and the grounding means includes the motor vehicle itself.

5. In an arrangement including a source of electrical power, glow plugs and a control circuit operably connected between the glow plugs and the source of electrical power, wherein the control circuit governs cycles of electrical power to the plugs, a testing mechanism exterior to an engine to determine whether the plugs receive power during the cycles, the mechanism comprising:

an elongate, generally tubular jacket conductive of electricity;

receptacles in the jacket, the receptacles defining passageways through the jacket;

walls of the receptacles conductive of heat and electricity;

the glow plugs extending through the jacket in the receptacles in thermal and electrical contact with the walls;

tips of the glow plugs extending beyond the jacket through first openings of the receptacles, the tips being in plain view;

posts of the glow plugs at second openings of the receptacles at opposite ends of the receptacles from the first openings;

means to circulate the coolant through the jacket past the receptacles; and means for grounding the receptacles.

* * * * *